US011585165B2

(12) United States Patent
Larkin

(10) Patent No.: US 11,585,165 B2
(45) Date of Patent: Feb. 21, 2023

(54) METHOD AND APPARATUS FOR HANDLING DRILL TUBES

(71) Applicant: Oiltech Automation Limited, Brighouse (GB)

(72) Inventor: Brendan Larkin, Brighouse (GB)

(73) Assignee: Oiltech Automation Limited, Brighouse (GB)

( * ) Notice: Subject to any disclaimer, the term of this patent is extended or adjusted under 35 U.S.C. 154(b) by 0 days.

(21) Appl. No.: 16/761,849

(22) PCT Filed: Nov. 8, 2018

(86) PCT No.: PCT/GB2018/053238
§ 371 (c)(1),
(2) Date: May 6, 2020

(87) PCT Pub. No.: WO2019/092424
PCT Pub. Date: May 16, 2019

(65) Prior Publication Data

US 2021/0198958 A1 Jul. 1, 2021

(30) Foreign Application Priority Data

Nov. 8, 2017 (GB) ..... 1718482

(51) Int. Cl.

| | |
|---|---|
| ***E21B 19/15*** | (2006.01) |
| ***E21B 19/20*** | (2006.01) |
| *E21B 15/00* | (2006.01) |
| *E21B 19/06* | (2006.01) |
| *E21B 19/24* | (2006.01) |

(52) U.S. Cl.
CPC ..... *E21B 19/155* (2013.01); *E21B 19/20* (2013.01); *E21B 15/00* (2013.01); *E21B 19/06* (2013.01); *E21B 19/24* (2013.01)

(58) Field of Classification Search
CPC ..... E21B 19/155; E21B 19/20; E21B 15/00; E21B 19/06; E21B 19/24; E21B 19/15; E21B 19/10; E21B 19/12; E21B 19/102; E21B 19/087; B23Q 2220/002; B23Q 2039/004; B23Q 2003/155418; E02F 3/962; E02F 3/964; E02F 3/142
USPC ..... 414/724; 901/41
See application file for complete search history.

(56) References Cited

U.S. PATENT DOCUMENTS

| | | | | |
|---|---|---|---|---|
| 2,416,815 A | | 3/1947 | Calhoun | |
| 3,615,027 A | * | 10/1971 | Ham | E21B 19/14 414/22.71 |
| 3,840,128 A | * | 10/1974 | Swoboda, Jr. | B25J 9/045 414/728 |
| 3,976,207 A | * | 8/1976 | Schultz | E21B 15/00 414/22.51 |
| 4,077,525 A | | 3/1978 | Callegari et al. | |

(Continued)

FOREIGN PATENT DOCUMENTS

| | | | | |
|---|---|---|---|---|
| CA | 3000512 A1 | * | 5/2017 | F16L 1/207 |
| CA | 2921919 A1 | | 8/2017 | |
| WO | 2004/079147 A2 | | 9/2004 | |

*Primary Examiner* — Gregory W Adams
(74) *Attorney, Agent, or Firm* — Occhiuti & Rohlicek LLP

(57) ABSTRACT

A pipe handling apparatus, for handling drill tubes on a drilling platform, has an upper guide member 100 comprising a retention head mounted on an arm. The arm can extend telescopically so as to position it to allow the retention head to engage a drill tube for placement in and removal from a rack 230.

16 Claims, 11 Drawing Sheets

(56) References Cited

U.S. PATENT DOCUMENTS

| | | | | |
|---|---|---|---|---|
| 4,274,778 | A * | 6/1981 | Putnam | B25J 9/0084 175/85 |
| 4,725,179 | A * | 2/1988 | Woolslayer | E21B 19/20 175/52 |
| 5,093,978 | A * | 3/1992 | Binder | B23Q 3/1554 901/29 |
| 6,348,029 | B1 * | 2/2002 | Baumbusch | B23B 31/305 483/54 |
| 6,821,071 | B2 * | 11/2004 | Woolslayer | E21B 19/14 175/85 |
| 8,186,455 | B2 * | 5/2012 | Childers | E21B 19/155 175/52 |
| 8,317,448 | B2 * | 11/2012 | Hankins | E21B 19/14 414/22.68 |
| 8,747,045 | B2 * | 6/2014 | Belik | E21B 19/24 414/22.63 |
| 2004/0057815 | A1 | 3/2004 | Woolslayer et al. | |
| 2007/0010171 | A1 * | 1/2007 | Klotz | B24B 35/00 451/247 |
| 2010/0303586 | A1 | 12/2010 | Hankins et al. | |
| 2014/0328650 | A1 | 11/2014 | Hu | |
| 2016/0067840 | A1 * | 3/2016 | Fujimoto | B23Q 3/15713 483/58 |
| 2017/0268302 | A1 * | 9/2017 | Orr | E21B 19/24 |

* cited by examiner

METHOD AND APPARATUS FOR HANDLING DRILL TUBES

This application is the national phase under 35 USC 371 of international application no. PCT/GB2018/053238, filed Nov. 8, 2018, which claims priority from UK application no. 1718482.1 filed on Nov. 8, 2017. The entire contents of these applications are incorporated herein by reference in their entireties.

The present invention relates to a method and apparatus for handling drill tubes and is concerned in particular with a method and apparatus for handling drill pipes and drill collars on oil drilling rigs.

BACKGROUND

The framework for supporting a drilling apparatus on an oil rig is known as a derrick or mast 800, as shown in FIG. 1.

Storing and retrieving drill tubes on an oil drilling rig is an extremely dangerous and hazardous task undertaken by a human operative known as a derrickman. The derrickman's operating position varies from one drilling rig to another, however, they often work on a platform 810 towards the top of the derrick or mast 800.

When tripping out of a drill hole (removing) or tripping into a drill hole (installing) the drill tubes, one of the derrickman's tasks is to guide the top of each drill tube (not shown) from a rack 820 towards a lifting apparatus 830 suspended from above, within the derrick or mast 800. This task is often undertaken by the derrickman as he stands towards the top of the derrick or mast 800 on a narrow, cantilevered board 810. Working conditions can be hazardous not least because the board 810 can become slippery during adverse weather conditions.

The challenges associated with these tasks can often result in injury to, or even death of, the derrickman. The lifting apparatus 830 moves at high speeds, and when tripping in the drill tubes, it is the job of the derrickman to position the drill tubes such that they are caught by the lifting apparatus to be installed towards the top of the drill string (a series of drill tubes which extend into the drill hole). Similarly, when tripping out, the derrickman must manually manoeuvre the drill tube from the lifting apparatus 830 back to a storage position in the rack 820.

The individual drill tubes are often large, typically above metres in length, and weigh hundreds of kilograms. The manoeuvring of the drill tubes, especially when returning them to the rack 820, means that it is not uncommon for derrickmen to trap body parts between drill tubes resulting in crush injuries. Additionally, in adverse weather conditions, such as heavy rain and strong winds, it is not uncommon for the derrickman to trip, fall or otherwise become displaced off the board 810, resulting in catastrophic injury.

Accordingly, the present invention aims to provide an apparatus and method for handling drill tubes in which the above-mentioned disadvantages are at least partly overcome.

STATEMENTS OF INVENTION

The present invention is defined in the attached independent claims, to which reference should now be made. Further preferred features may be found in the sub-claims appended thereto.

According to a first aspect of the present invention, there is provided pipe handling apparatus for a drilling rig. In one arrangement there is provided an upper guide apparatus for handling drill tubes on a drilling platform; the apparatus comprising a retention head mounted on an arm; wherein the arm is positionable so as to allow the retention head to engage a drill tube for placement in and removal from a rack.

The arm may comprise an upper arm.

Preferably, the arm comprises a plurality of sections. The sections may be connected together and arranged to extend and contract, preferably telescopically.

Optionally, the apparatus comprises a machine housing, and the arm is arranged to pivot/rotate about an axis extending through the machine housing.

The machine housing may be arranged to move along a track. The track may be arranged to extend transversely with respect to at least one rack.

The track may be positioned under a support platform of the drilling platform. This allows for easy access to the machine housing and track when performing maintenance, and to allow better visibility of the functioning of the apparatus. This position also enables the arm to be stored away from the other operating aspects of the drilling rig.

The retention head may comprise a capturing means for selecting and capturing a drill tube.

Preferably, the capturing means comprises a static portion and a movable portion. The movable portion may be arranged to rotate so as to grip a drill tube when in use. This allows the same retention head to be used for drill tubes of a number of diameters.

The movement of the arm and/or retention head may be by electrical motor, hydraulics and/or pneumatics.

According to a second aspect of the present invention, there is provided a lower guide apparatus for handling drill tubes on a drilling platform; the apparatus comprising an arm mounted for pivotable movement, and a head portion for supporting a drill tube in use.

Preferably, the arm is mounted for pivotable movement about two axes.

The head portion may be moveable between two configurations, to present two different support tools to a drill tube.

The tools may include a guide head and/or a roller. Preferably, the guide head and roller are sized to accommodate a plurality of drill tube sizes.

The head portion may be locked in a chosen configuration with a locking mechanism when a tool has been chosen.

The arm may pivot about a vertical axis within a predetermined angle. The predetermined angle may be +/−20 degrees from a mean position.

The movement of the arm may be effected by electrical motor, hydraulics and/or pneumatics.

According to a third aspect of the present invention there is provided a method for handling drill tubes on a drilling platform, the method comprising selecting a drill tube; and guiding an upper portion of the drill tube with an upper guide arm.

Preferably the method includes guiding a lower portion of the drill tube with a lower guide arm; so as to move the drill tube between a first, stowed position and a second, operative position.

Preferably, the upper guide arm and lower guide arm are automatically directed, more preferably in a coordinated manner, to a drill tube once selected. Additionally, or alternatively, the user may control the positioning of the upper guide arm and/or lower guide arm, optionally independently of one another.

The user may control the upper guide arm and/or the lower guide arm via an interface.

Optionally, the interface may include a joystick.

The method may include electronically monitoring the position of the upper guide arm and the lower guide.

The stowed position may comprise a position in a rack and the operative position may comprise a substantially central location with respect to the rig.

The lower guide arm may be arranged to guide the lower portion of the drill tube using a guide head, and/or a roller.

Preferably, the lower guide arm is arranged to rotate about a first pivot to guide the lower portion of the drill tube between positions. The lower guide arm may also rotate about a second pivot to guide the lower portion of the drill tube between positions.

Optionally, the upper guide arm comprises an extendable, preferably telescopic, arm arranged in use to position the upper guide arm for retrieval/storage of a drill tube. The upper guide arm may be attached to a track which may be used for constraining and/or predefining the movement.

The movement of the upper and/or lower arm may be effected by an electrical motor, hydraulics and/or pneumatics.

The upper guide arm and lower guide arm may be according to any statement herein.

According to a fourth aspect of the present invention there is provided a system for handling drill tubes on a drilling platform, the system comprising an upper guide arm and a lower guide arm; wherein the upper guide arm guides an upper portion of the drill tube; and the lower guide arm guides a lower portion of the drill tube; so as to move the drill tube between a first, stowed position and a second, operative position.

The stowed position may correspond to a drill tube in a rack and the operative position may be a location substantially central with respect to the rig.

The movement of the upper and/or lower arms may be effected by an electrical motor, hydraulics and/or pneumatics.

The upper guide arm and lower guide arm may be according to any statement herein.

The invention also comprises a program for causing a device to perform a method according to any statement herein.

According to another aspect of the present invention, there is provided an apparatus comprising a processor and a memory having therein computer readable instructions, the processor being arranged in used to read the instructions to cause the performance of a method for handling drill tubes on a drilling platform, the method comprising selecting a drill tube; guiding an upper portion of the drill tube with an upper guide arm; and guiding a lower portion of the drill tube with a lower guide arm; so as to move the drill tube between a first, stowed position and a second, operative position.

The invention also includes a computer implemented method comprising handling drill tubes on a drilling platform, the method comprising selecting a drill tube; guiding an upper portion of the drill tube with an upper guide arm; and guiding a lower portion of the drill tube with a lower guide arm; so as to move the drill tube between a first, stowed position and a second, operative position.

In a further aspect, the invention provides a computer program product on a non-transitory computer readable storage medium, comprising computer readable instructions that, when executed by a computer, cause the computer to perform a method of handling drill tubes on a drilling platform, the method comprising selecting a drill tube; guiding an upper portion of the drill tube with an upper guide arm; and guiding a lower portion of the drill tube with a lower guide arm; so as to move the drill tube between a first, stowed position and a second, operative position.

The invention may include any combination of features or limitations referred to herein, except such a combination of features as are mutually exclusive, or mutually inconsistent.

BRIEF DESCRIPTION OF THE FIGURES

Preferred embodiments of the present invention will now be described by way of example only with reference to the accompanying drawings, in which.

Throughout the figures, like reference numbers refer to like features

SPECIFIC DESCRIPTION

The present invention provides apparatus and a method for handling drill tubes, such as drill pipes or drill casings on a drilling platform. The handling of drill tubes is commonly undertaken by a derrickman on a platform at the top of the drilling platform. The derrickman is responsible for moving/guiding the drill tubes into and out of position as they are added to and removed from the drill string. The weight of these tubes means that this job is extremely hazardous and can often result in injuries such as crushed digits. Additionally, as these tasks take place at the top of a drill rig, often 27 m (90 feet) or more in the air, on a narrow platform, adverse weather conditions can result in falls which may cause further injury.

Figure 1:
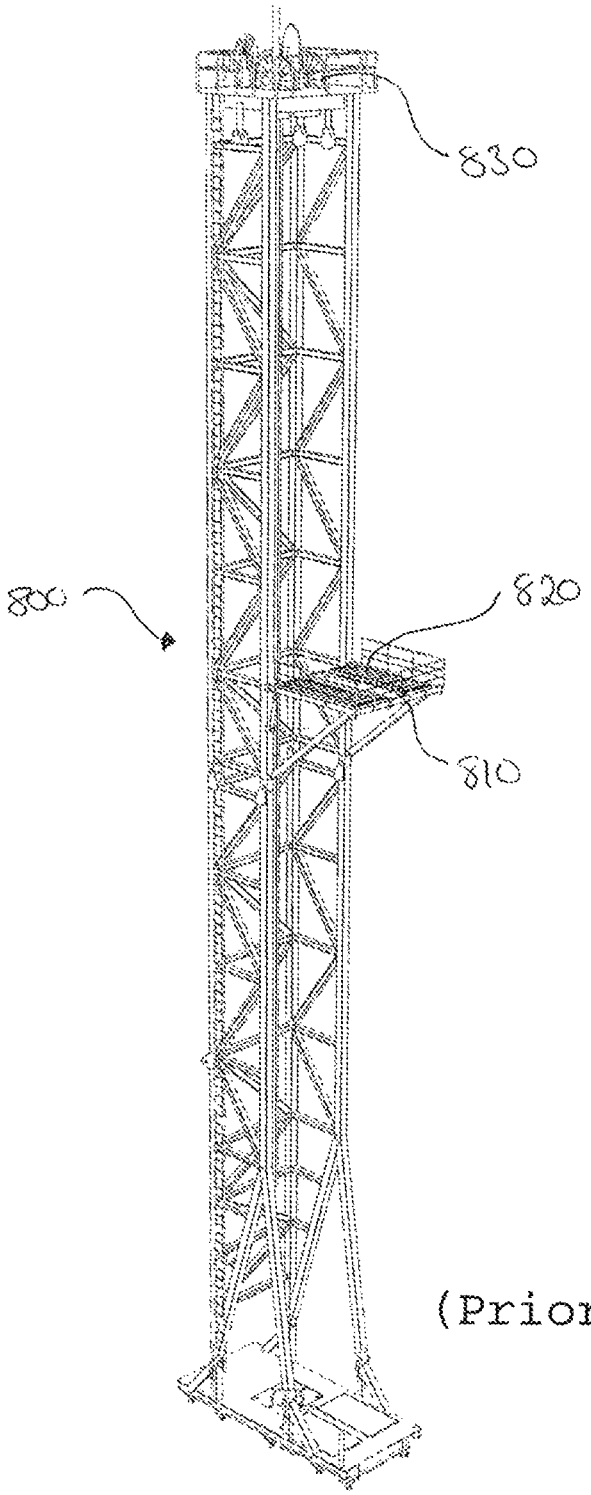
(Prior Art) Fig. 1
FIG. 1 is an example of a previously considered drill floor and drilling mast.
Figure 2:
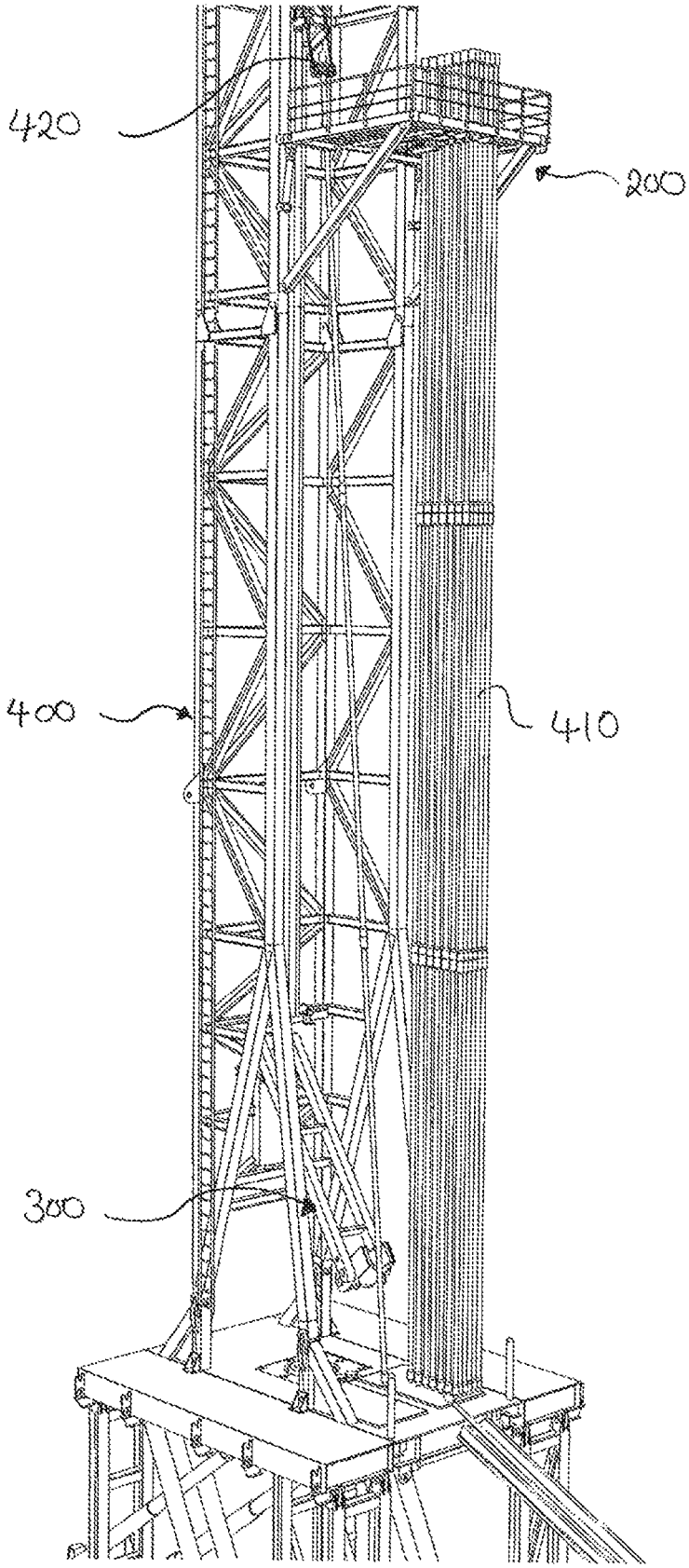
FIG. 2 is an overview of a drill floor and drilling mast having the platform and lower arm attached in accordance with an embodiment of the present invention.

FIG. 2 shows an example of a platform 200 and a lower arm assembly 300 when installed, or retrofitted, on an existing drilling rig 400.

Figure 3:
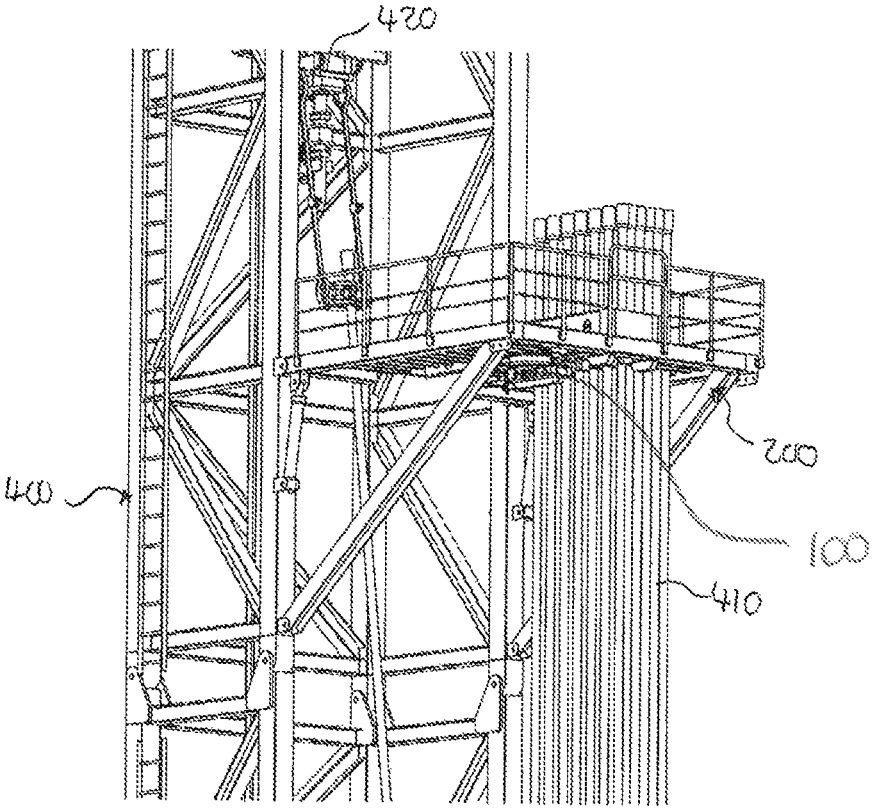
FIG. 3 is a close-up view of an upper portion of the drilling rig of FIG. 2.

FIG. 3 shows the upper portion of one of the drill tubes 410 has been secured in the lifting assembly 420 of the drilling rig 400. The platform 200 comprises an upper guide arm 100 for guiding the upper portion of one of the drill tubes 410 into position.

Figure 4:
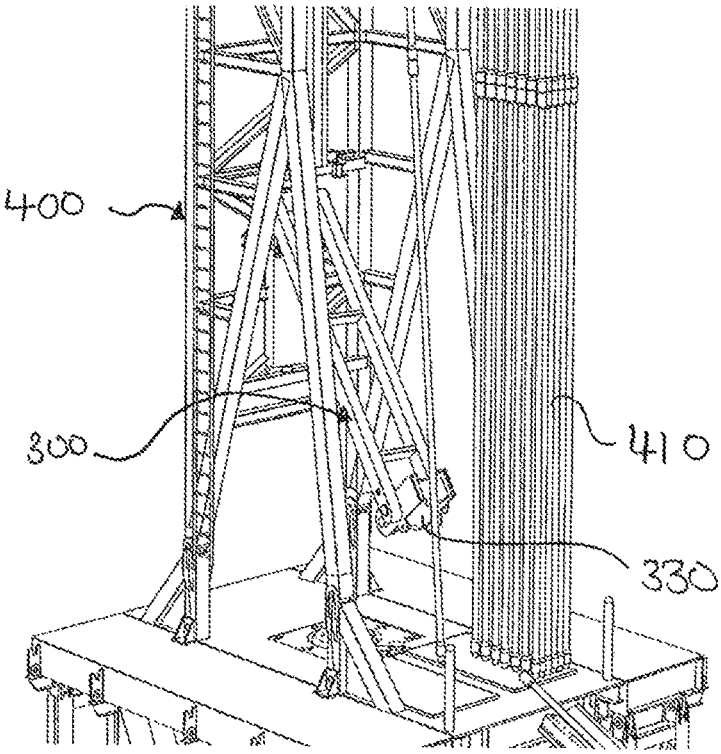
FIG. 4 is a close-up view of a lower portion of the drilling rig of FIG. 2.

At the lower portion of the rig 400, as shown in FIG. 4, the lower part of one of the drill tubes 410 is being guided into position over the rest of the drill string (not shown) by the lower guide arm 300. The lower guide arm 300 has a turret head 330. Collars are tubes having a diameter of 0.1 meters-0.6 meters, and may be moved into a substantially vertical position, and into a substantially central location with respect to the drilling rig.

The upper 100 and lower 300 guide arms are operated under the control of an operative, usually at ground level.

Figure 5:
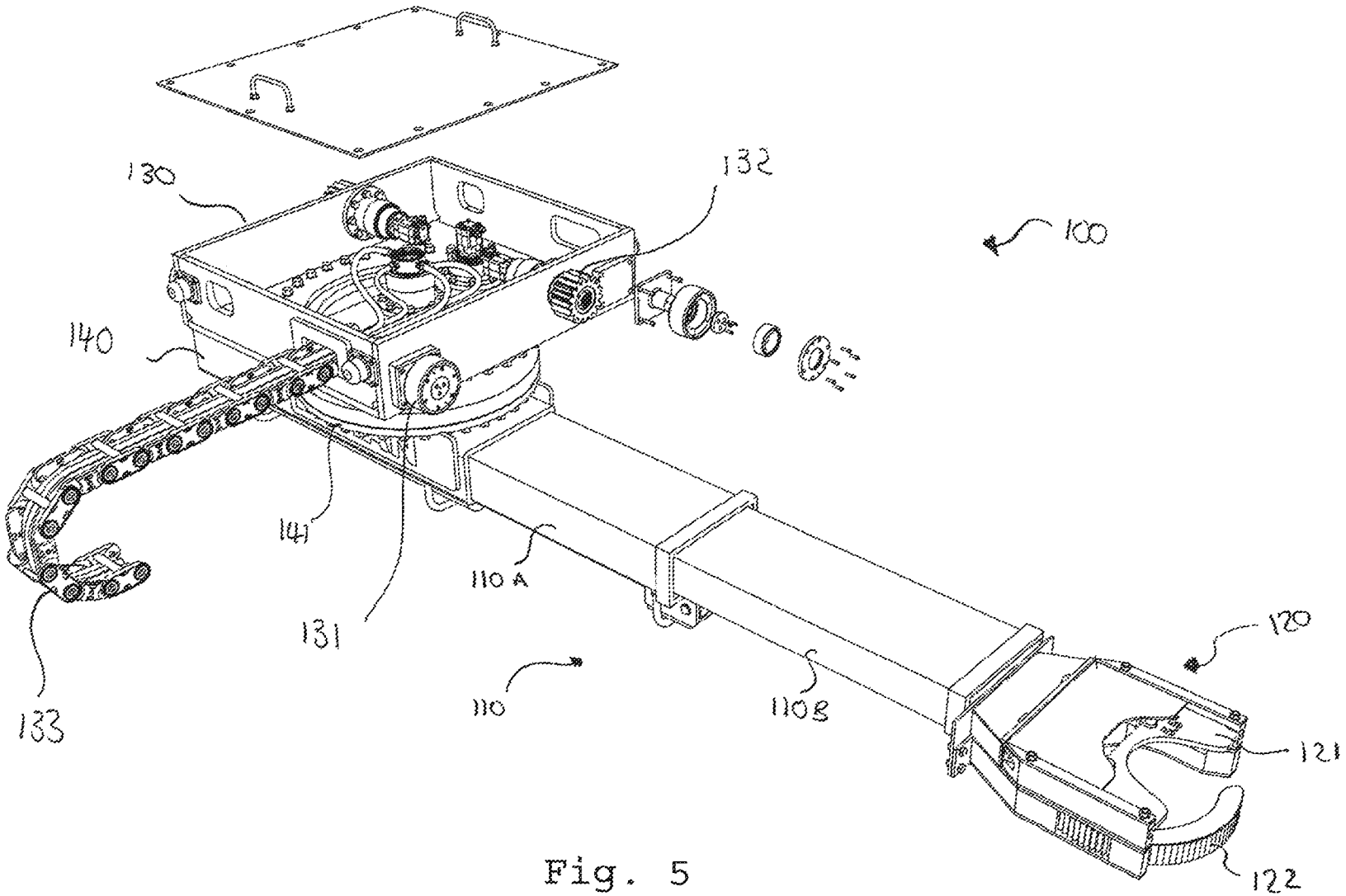
FIG. 5 is an exploded perspective view of an upper arm in accordance with an embodiment of the invention.

FIG. 5 shows a schematic exploded view of an upper arm 100 for mounting on a drilling platform (not shown) for handling drill tubes. The arm 100 comprises a telescopically extending portion 110 made up of at least two sections 110A, 110B terminating with a retention head 120 for holding a tube (not shown). The telescopic sections of the example are made from high-strength weldable steel which allows for a simpler design and a lower weight than is the case with previously considered apparatus made from standard sections of lower grade steel.

The telescopic portion 110 is arranged so that the first section 110A is substantially hollow and has a larger cross-section than the second section 110B. The second section 110B is arranged in use to move laterally within the interior space of the first section 110A so that the length of the telescopic section 110 can be controlled so as to be able to reach objects at varying distances. The telescopic section 110 may be controlled hydraulically, pneumatically and/or by electrical motors (not shown).

The retention head 120 is positioned at the end of the second section 110B and enables the arm 100 to select drill tubes (not shown) from one or more predetermined locations. The retention head 120 comprises a drill tube adaptor 121 and a movable retaining finger 122. The drill tube adaptor 121 moves transversely with respect of the axis of extension/longitudinal axis, within the retention head 120 thereby allowing the retention head 120 to hold drill tubes of varying diameters. The finger 122 is arcuately curved and can move between an open and a closed position so as to grip/release a drill tube. The finger 122 may comprise a rack which interacts with a gear (not shown) within the retention head 120 enabling the finger 122 to move between open and closed positions. The finger/gear may be controlled electrically, hydraulically, or pneumatically within the retention head 120.

The telescopic arm 110 is pivotably connected to a machine housing 130 via a mounting member 140. The telescopic section 110 is arranged to connect to the mounting member 140 such that the first portion 110A is arranged to move laterally within the cross-section of the mounting member 140.

The mounting member 140 comprises a pivot 141 which extends into the machine housing 130, and is operable to rotate, thereby causing the telescopic section 110 and retention head 120 to rotate in use. The pivot 141 comprises a slew ring which in some embodiments may comprise a roller bearing and/or teethed outer pinion which is driven hydraulically, pneumatically, and/or via an electric motor.

The machine housing 130 is connected to a track (not shown) and comprises two or more supporting members 131 (one for each side) which interact with the track and ensure the arm 100 follows the track. The machine housing 130 also comprises a propulsion means 132, such as a gear arranged to interact with a rack mounted on or within the track. The necessary connections, such as hydraulic, pneumatic, and electrical cables and pipework are connected to drag chain 133 which moves along with the arm and ensures the cables/pipework are organised and do not become tangled and/or damaged.

Figure 6:
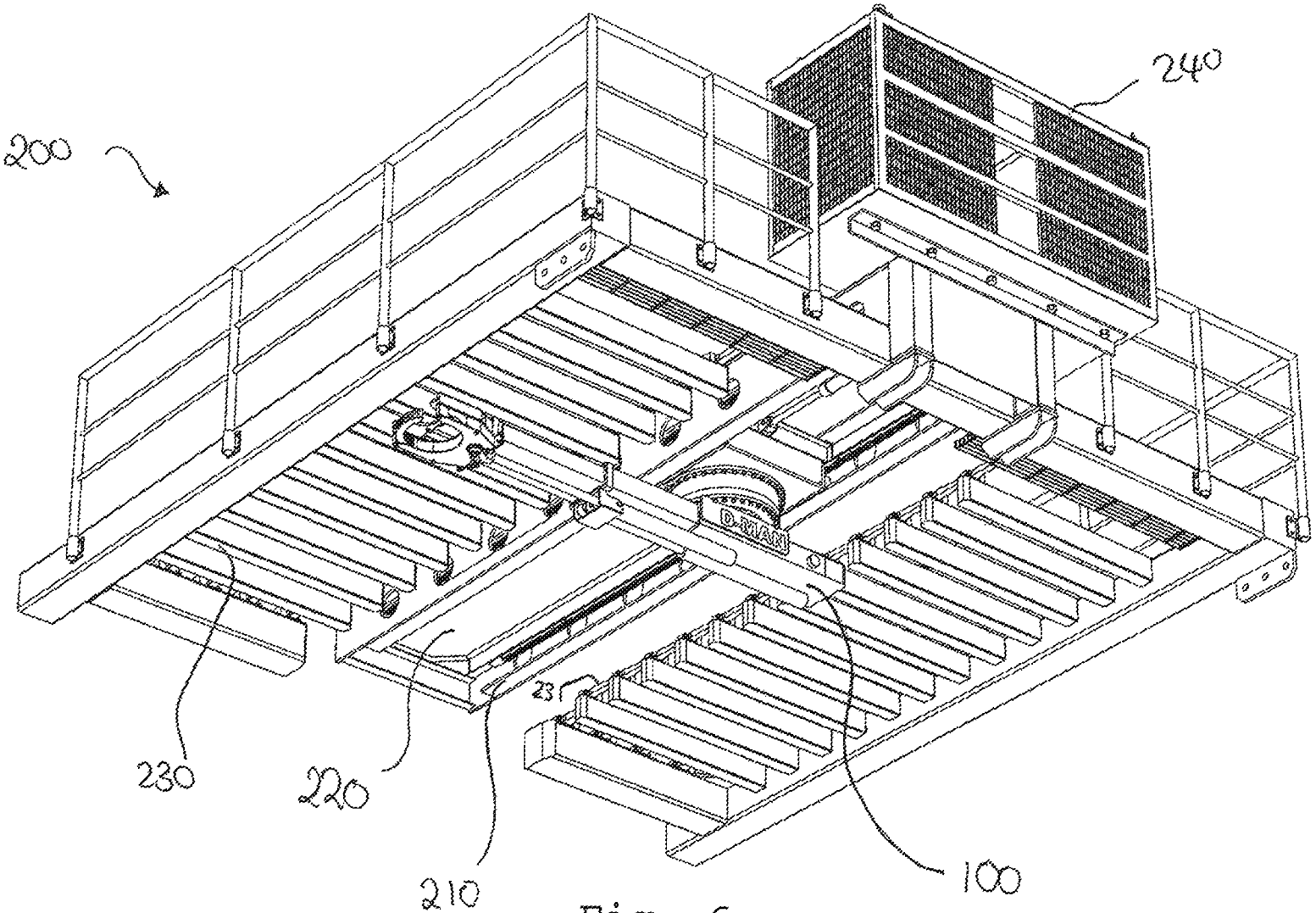
FIG. 6 is a perspective view from below of a platform with an upper arm.
Figure 7:
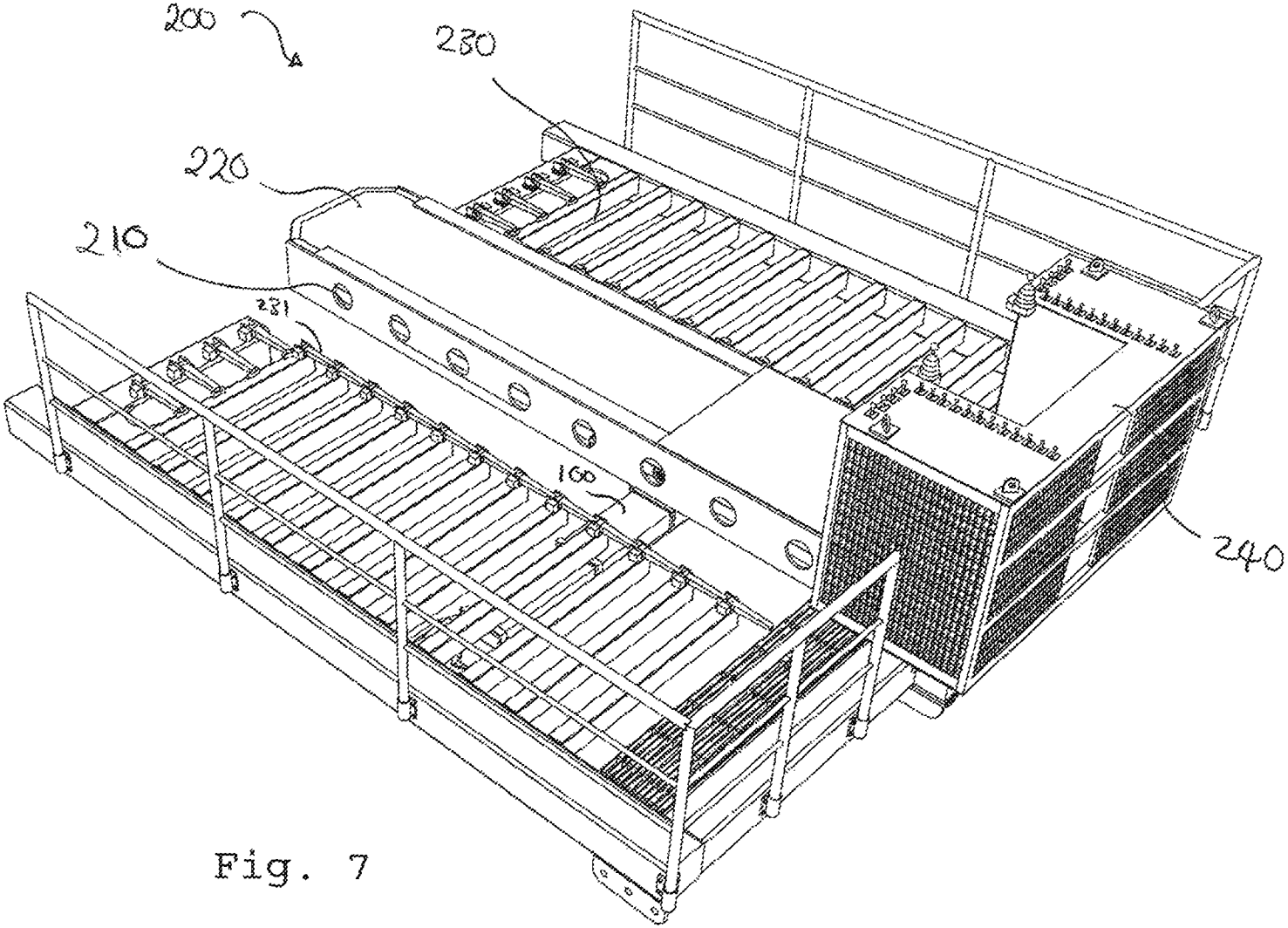
FIG. 7 is an upper perspective view of the platform of FIG. 6.

FIG. 6 shows a lower perspective view of the drill tube storage platform 200 and mounting location for the arm 100 shown in FIG. 5. In this example the arm is mounted below the platform, which allows for good visibility from below. FIG. 7 shows an upper perspective view of the platform 200. The platform 200 is arranged to be mounted on an upper portion of a drilling rig (not shown). The arm 100 is mounted on a track 210 located below a support platform 220. As mentioned above, the arm 100 is arranged to move along the track 210 so as to be positioned for retrieving or storing drill tubes (not shown) in one or more racks 230. In use, drill tubes are arranged vertically within the one or more racks and prevented from being removed by a closing gate 231 which is operable to open and close during the retrieval and storage process. This also provides added safety in the event of adverse weather conditions, such as high wind. The platform may also comprise a control station 240 which enables a user to manually control the arm 100, and other equipment, whilst obviating the need for direct handling of the drill tubes. Whilst this still requires a user to be positioned on the platform 200, it will result in a reduction of injuries, especially crush injuries, from direct handling of the tube.

Figure 8:
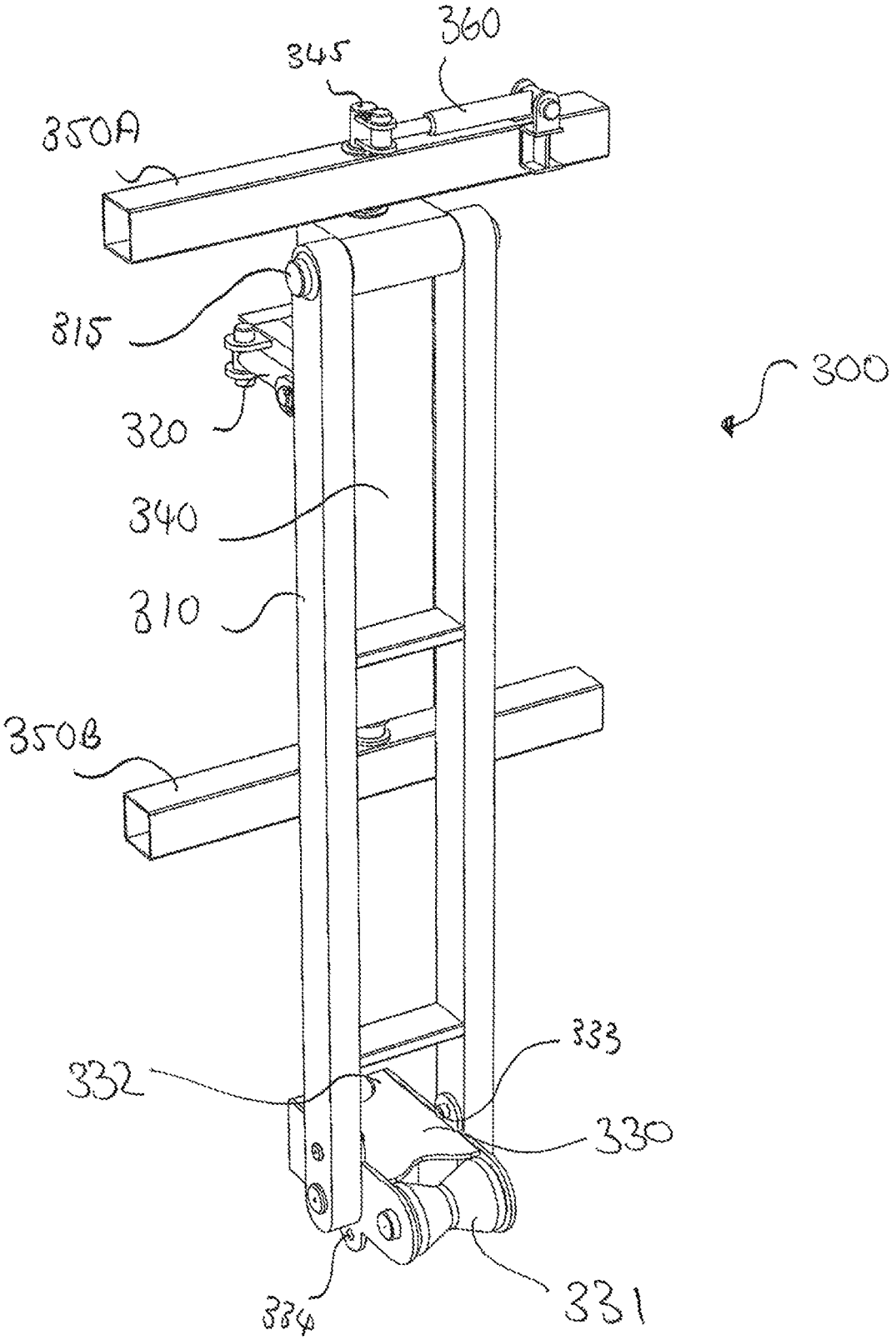
FIG. 8 is a perspective view of a lower arm in accordance with an embodiment of the invention.
Figure 9:
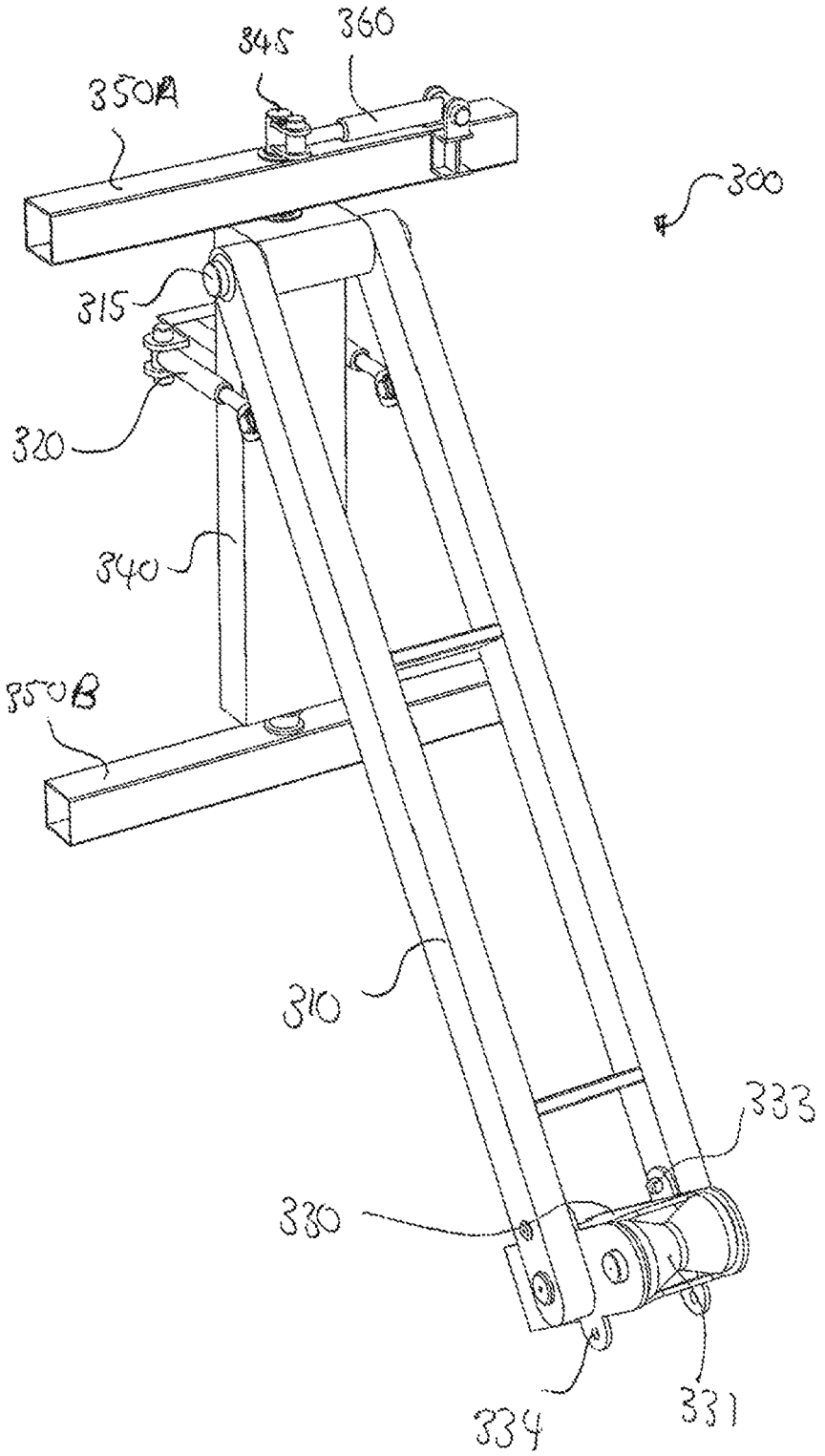
FIG. 9 is a perspective view of the lower arm of FIG. 8 in an extended position.
Figure 10:
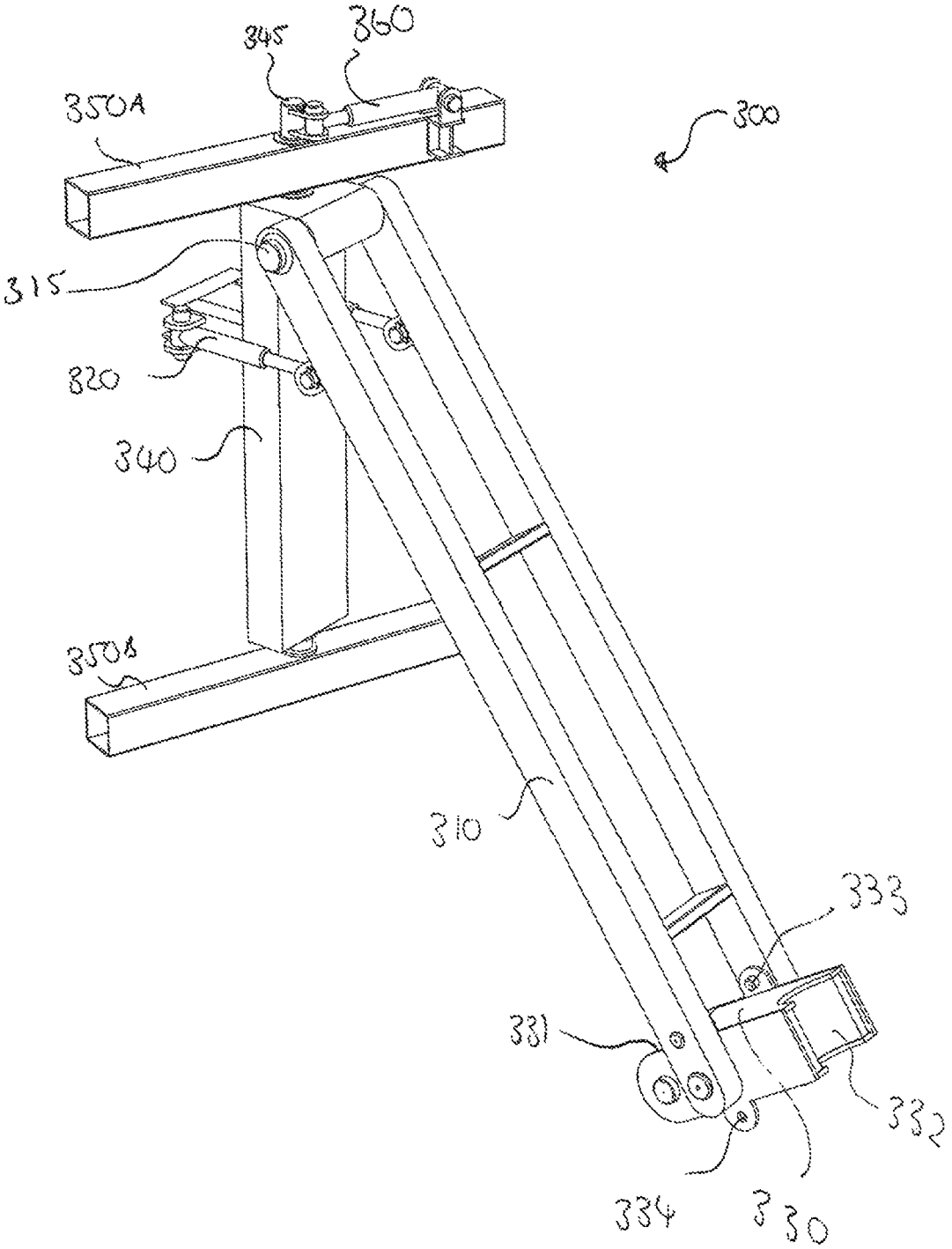
FIG. 10 is a perspective view of the lower arm of FIG. 8 in an extended and rotated position.

FIGS. 8-10 show a lower arm 300 for guiding a lower portion of the drill tube (not shown) into position when removing from, or storing in, the racks 230 of FIGS. 6 and 7.

The lower arm 300 comprises an arm member 310 connected to a first pivot 315 at a proximal end. At an opposing distal end, the arm 310 comprises a turret head 330. The turret head 330 is pivotably mounted on the arm member 310 and has at least two positions providing tools for different tasks such as the task of tripping and tailing tubes/collars of differing diameters.

When in a first position, as shown in FIGS. 8 and 9, the turret 330 is positioned such that a first tool 331 is available for use. The first tool 331 may be a roller for use when tailing/running in. The roller 331 is arranged to contact the lower portion of a drill tube/collar and guide it into position. In other scenarios, the turret 330 may be rotated about the pivot and secured in position such that a second tool 332 is available for use as shown in FIG. 10. The second tool may comprise a concave, preferably semi-circular recess in the turret head 330 for contacting with, and guiding, the drill tube into position.

As mentioned above, the turret 330 may rotate about a pivot. The turret 330 is secured in position using a locking pin 333 which is arranged when in the locked position, to extend through an aperture 334 in the turret 330. It will be appreciated that the rotation and locking of the turret 330 may be manually controlled, or alternatively, one or both operations may be powered, for example by way of an electric motor.

The arm member 310 is arranged rotate about the first pivot 315 such that the turret head moves arcuately away from the drill rig (not shown). This motion may be controlled electrically, hydraulically, or pneumatically, for example using pistons 320 as shown in FIG. 9.

The entire lower arm assembly 300 is positioned on a support 340 between two horizontal supports 350A,350B of the drill rig. The support 340 is pivotably connected between the horizontal supports 350A,350B via a vertical pivot 345 thereby allowing the arm member 310 to rotate about the vertical pivot 345 so as to extend the range of the arm. As with the first pivot 315, the vertical pivot 345 may be hydraulically, pneumatically or electrically operated by way of an upper piston 360 enabling horizontal movement by rotating the support 340 which is associated with the first pivot 315. For example, the support 340 may rotate +/−20 degrees as shown in FIG. 10 which shows the arm extended and rotated at an angle.

Figure 11:
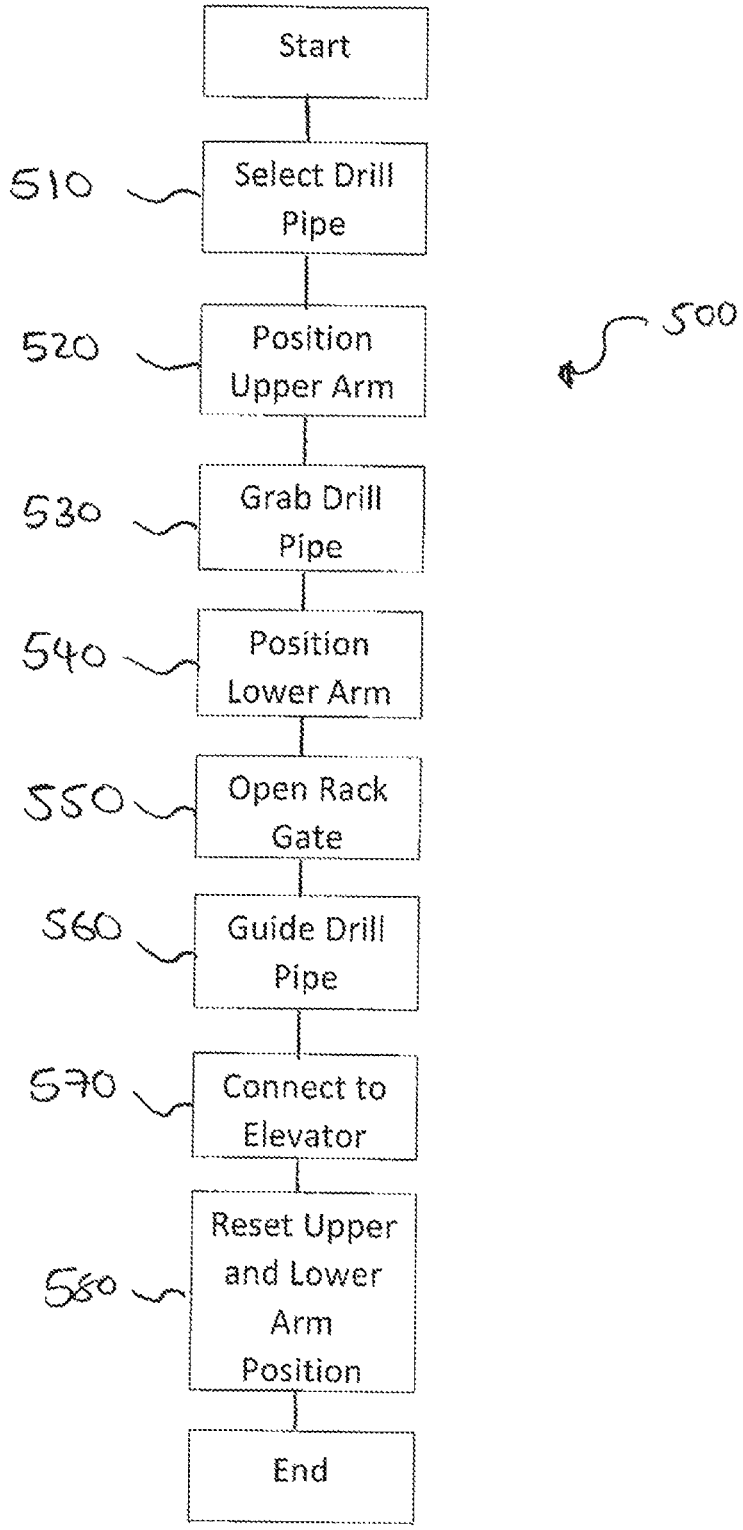
FIG. 11 is a flowchart showing the steps of selecting and installing a drill tube.

FIG. 11 is a flowchart indicating the steps for selecting a drill tube and moving it into position for connection to a drill string (tailing). At step 510 an operator indicates which drill tube from the drill tube rack 230 is to be selected. The method then moves to step 520 where the upper arm 100 is moved into position. The method moves to step 530, and the retention head 120 of the upper arm 100 is directed to grab the selected drill tube. This is achieved by extending the telescopic section 110 of the upper arm 100, and then by using the drill tube adaptor 121 and the finger 122 to securely grasp the selected drill tube. Once the system is notified, either manually or via one or more sensors, that the drill tube has been securely captured, the method moves to step 540 where the lower arm 300 is positioned such that the turret head 330, with the roller 331 in use, is resting against the lower portion of the selected drill tube. Once in position, the securing rack gate 231 is opened. The method then moves to step 560 wherein the upper arm 100 and the lower arm 300 synchronously move to guide the drill tube into position. Once in position, the method moves to step 570 where the drill tube is connected to the elevator 420. The method then moves to step 580 where the drill tube is released and the upper 100 and lower 300 arms are reset to their starting position, ready to select the next drill tube for connection to the drill string.

Figure 12:
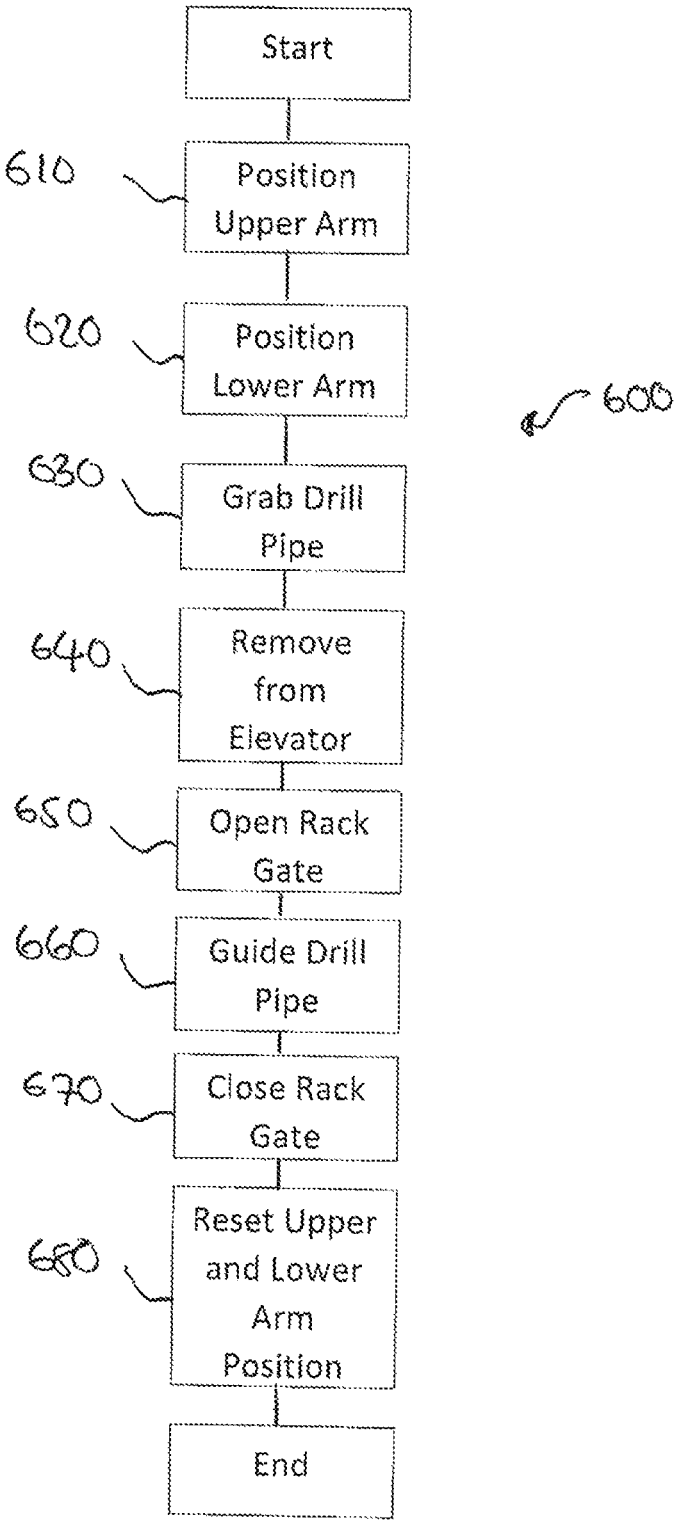
FIG. 12 is a flowchart showing the steps of removing a drill tube from a drill string and storing in a rack in accordance with an embodiment of the present invention.

FIG. 12 is a flowchart indicating the steps for removing a drill tube from a drill string and storing it in the rack 230. Once the drill tube is in position at step 610 the upper arm 100 is positioned to grab the upper portion of the drill tube. The method then moves to step 620 where the lower arm 300 is positioned so that the turret head 330, with the racking head portion 332 in use, contacts the lower portion of the drill tube. Once in position, the method moves to step 630 where the retention head 120 grabs the upper portion of the drill tube. The drill tube is then removed from the elevator 420, at step 640 and the method progresses to step 650 wherein the rack gate 231 of the selected racking position is opened. The method then moves to step 660 where the drill tube is guided to the selected racking position using the upper 100 and lower 300 arms. Once in position, the method moves to step 670 wherein the rack gate 231 is closed. The method then progresses to step 680 where the upper 100 and lower 300 arm positions are reset.

Embodiments of pipe handling apparatus according to the present invention employ telescoping sections to extend and retract an upper arm/guide so that drill tubes can efficiently be stowed in a tube rack or withdrawn therefrom and taken to an operative position for use. The telescopic approach allows good dimensional control whilst providing excellent strength to weight ratio. As a result, the apparatus is compact/shallow and light in weight in contrast with a scissor or V-frame structure.

The relative compactness and lightness means that the apparatus is easy to install and dismantle. In particular, the apparatus may be stowed with the racking board/platform. This means that the apparatus is particularly suited to use with smaller drilling rigs, and operations with a relatively short duration, such as is the case with many land-based rigs. The resultant saving of work in setting up and later dismantling when moving to a new location lessens costly downtime, when the rig is not productive.

Whilst endeavouring in the foregoing specification to draw attention to those features of the invention believed to be of particular importance, it should be understood that the applicant claims protection in respect of any patentable feature or combination of features referred to herein, and/or shown in the drawings, whether or not particular emphasis has been placed thereon.

The invention claimed is:

1. A method for handling drill tubes on a drilling platform, the method comprising selecting a drill tube and guiding an upper portion of the drill tube with an upper guide arm, and guiding a lower portion of the drill tube with a lower guide arm, wherein the lower guide arm comprises a head portion that is moveable between two configurations, to present two different support tools to the drill tube, wherein the head portion comprises a turret head, which is pivotably mounted on the lower arm and is rotatable between two positions providing the two different support tools, and wherein the method further includes rotating the turret head between the two positions to present the two different support tools to the drill tube.

2. A method according to claim 1, comprising guiding the lower portion of the drill tube with the lower guide arm; so as to move the drill tube between a first, stowed position and a second, operative position.

3. The method according to claim 2, wherein the upper guide arm and lower guide arm are automatically directed to the drill tube once selected.

4. The method according to claim 1, wherein the upper guide arm comprises an extendable, telescopic, arm arranged in use to position the upper guide arm for retrieval/storage of the drill tube.

5. The method according to claim 1, wherein in a first position the turret head is provided with a roller tool comprising a roller arranged to contact the drill tube, and wherein in a second position the turret head is provided with a concave tool comprising a semi-circular recess arranged to contact the drill tube.

6. A pipe handling apparatus for handling drill tubes on a drilling platform, the apparatus including an upper guide member comprising a retention head mounted on an upper arm; wherein the upper arm is positionable so as to allow the retention head to engage a drill tube for placement in and removal from a rack, and further comprising a lower guide member for handling drill tubes, the member comprising a lower arm mounted for pivotable movement, and a head portion for supporting the drill tube in use, wherein the head portion moves between two configurations, to present two different support tools to the drill tube, wherein the head portion comprises a turret head, which is pivotably mounted on the lower arm and that rotates between two positions respectively associated with the two different configurations, to provide a respective one of the two different support tools to engage the drill tube.

7. The apparatus according to claim 6, wherein the upper arm comprises a plurality of sections connected together telescopically and arranged to extend and contract.

8. The apparatus according to claim 6, wherein the upper arm is arranged in use to pivot/rotate about a substantially vertical axis.

9. The apparatus according to claim 6, wherein the upper arm is arranged to move along a track.

10. The apparatus according to claim 9, wherein the track is positioned under a rack support platform.

11. The apparatus according to claim 6, wherein the upper arm is mountable to an underside of a rack support platform for stowing drill tubes.

12. The apparatus according claim 6, wherein the retention head comprises a static portion and a movable portion.

13. The apparatus according to claim 12, wherein the movable portion is arranged to rotate so as to grip the drill tube when in use.

14. The apparatus according to claim 6, wherein the movement of the arm and/or retention head is arranged to be achieved by electrical motor, hydraulics and/or pneumatics.

15. The lower guide apparatus of claim 6, wherein the lower arm is mounted for pivotable movement about two axes.

16. The pipe handling apparatus according to claim 6, wherein in a first position the turret head is provided with a roller tool comprising a roller arranged to contact the drill tube, and wherein in a second position the turret head is provided with a concave tool comprising a semi-circular recess arranged to contact the drill tube.

* * * * *